United States Patent [19]

Furutsu

[11] 4,456,162

[45] Jun. 26, 1984

[54] TAG ATTACHER

[75] Inventor: Akira Furutsu, Tokyo, Japan

[73] Assignees: Ben Clements & Sons, Inc., South Hackensack, N.J.; Japan Bano'k Co., Ltd., Tokyo, Japan

[21] Appl. No.: 329,086

[22] Filed: Dec. 9, 1981

[30] Foreign Application Priority Data

Dec. 16, 1980 [JP] Japan ..... 55-177574

[51] Int. Cl.[3] ..... B26C 5/06

[52] U.S. Cl. ..... 227/67

[58] Field of Search ..... 227/67; 226/67–68, 226/120–121, 127–128, 134, 165–166; 198/750, 772, 859

[56] References Cited

U.S. PATENT DOCUMENTS 4,310,962 1/1982 Suzuki ..... 227/67

*Primary Examiner*—Don Schran

*Assistant Examiner*—Douglas D. Watts

*Attorney, Agent, or Firm*—Blum, Kaplan, Friedman, Silberman & Beran

[57] ABSTRACT

The means for feeding a tag pin assembly in this tag attacher consists of a cam plate which can be moved up and down along a guide bore in which the tag pin assembly is inserted, a locking member pivotably provided on the cam plate, and a spring provided between the locking member and the tag attacher body. The locking member has locks adapted to come into contact with the opposite surfaces of a connecting bar in the tag pin assembly so as to apply force thereto for moving the same. When the cam plate is moved upward against the force of the spring during a tag pin-driving operation, opposite surfaces of the connecting bar are pressed and held by the locking member oscillatably provided on the cam plate. When the lever provided on the tag attacher body is released from the gripping force applied thereto, the cam plate is lowered by the resilient force of the spring to feed a tag pin in the tag pin assembly to a driving position in a rear portion of a side-slitted needle.

9 Claims, 9 Drawing Figures

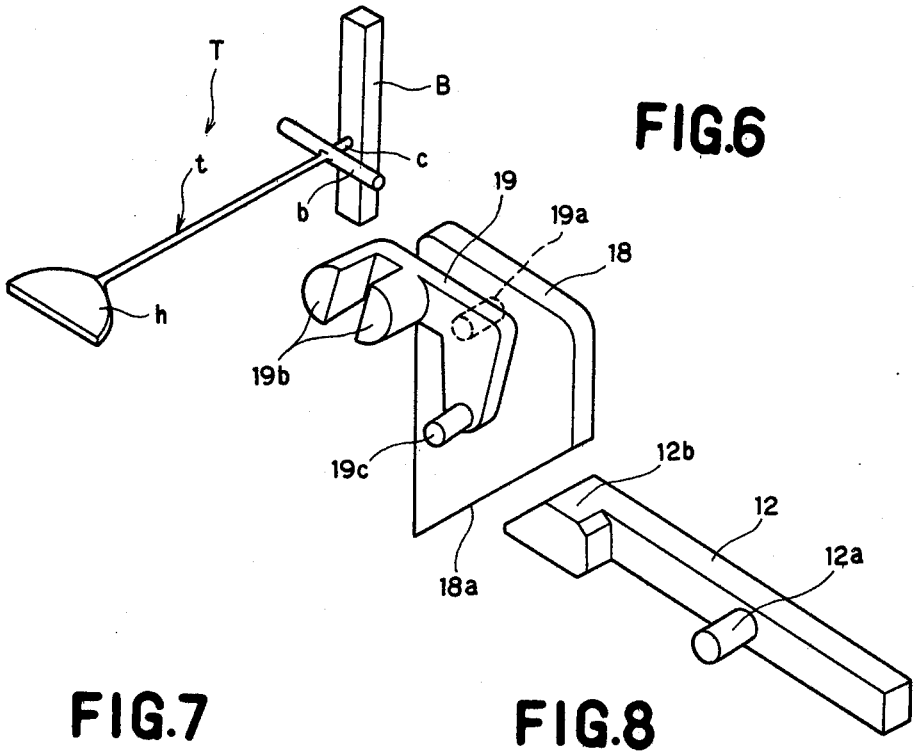
FIG.6
FIG.7
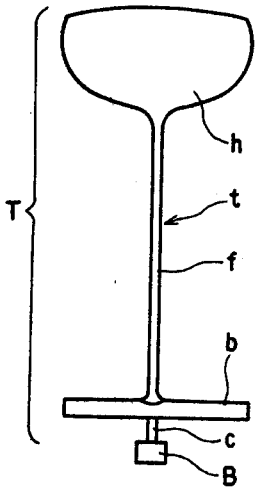
FIG.8
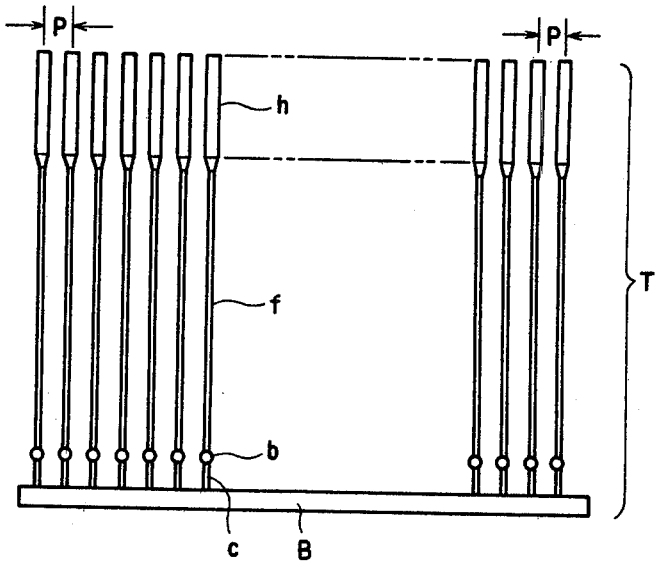

TAG ATTACHER

BACKGROUND OF THE INVENTION

1. Field of the Invention

This invention relates to a tag attacher, and more particularly to a tag attacher for use in affixing price tags or the like to articles with synthetic resin tag pins.

2. Description of the Prior Art

Synthetic resin tag pins have heretofore been used to attach price tags or the like to articles.

Each tag pin consists of a head portion, a lateral rod, and a filament connecting the mentioned two portions together. The tag pin as a whole is substantially in the shape of the letter "H". This tag pin is affixed to an article by using a tag attacher. In order to carry out a tag pin-affixing operation conveniently, a tag pin assembly is molded out of synthetic resin into an integral comb-like body consisting of a plurality of tag pins joined to a connecting bar with the tag pins arranged at predetermined intervals in the direction of the thickness thereof or spaced in this direction with a predetermined pitch.

Thus, the tag pins are joined via their respective connecting portions to the connecting bar to form a comb-like body, the number of tag pins provided therein being as large as 30–100.

It has been desired that not one but a plurality of types of tag pins having filaments of various lengths be manufactured. It is necessary to selectively use tag pins having filaments of different lengths in accordance with the kind of articles to which the tag pins are to be attached. In some cases, it is necessary to use tag pins having head portions of different sizes. When the length of the filaments and the sizes of the head portions of the tag pins are varied, the intervals or pitch thereof is necessarily varied.

On the other hand, the tag attacher is generally in the shape of a pistol. Every time the lever of the pistol type tag attacher is drawn, a tag pin is separated from a tag pin assembly loaded therein. The lateral rod of the tag pin is then guided into the bore of a side-slotted hollow needle fixed to the front of the tag attacher to be passed through a price tag or the like and an article. When the tag pin has been completely forced out from the hollow needle, the price tag or the like is affixed to the article therewith.

A conventional tag attacher employs a means for feeding a tag pin assembly which consists of a gear. The teeth of the gear fit among the connecting portions of the tag pins which join the tag pins to the connecting bar of the tag assembly. The tag pins are intermittently fed by the gear to the inlet of the hollow needle referred to above.

However, since the pitch of the teeth of the gear constituting the tag pin feed means is, of course, fixed, it is clear that the tag attacher can only use a tag assembly that has tag pins spaced with the same pitch as the teeth of the gear.

Therefore, it is necessary to prepare a plurality of tag attachers which can attach tag pin assemblies having connecting portions of various pitches. In addition, the size of each portion of the tag pins varies depending upon the manufacturer thereof, so it is difficult to load tap pins made by various manufacturers with one tag attacher. Thus there is a demand for a tag attacher free from the above-mentioned problems which can affix various types of tag pins to articles.

SUMMARY OF THE INVENTION

The present invention has been achieved on the basis of the inventor's efforts directed to eliminate the above-mentioned drawbacks encountered in a conventional tag attacher.

An object of the present invention is to provide a tag attacher which can attach various types of tag assemblies irrespective of the pitch of the tag pins thereof.

The above and other objects and advantages of the invention will become apparent from the following description of preferred embodiments taken in conjunction with the accompanying drawings.

The characteristics of the present invention reside in a tag attacher comprising a tag attacher body, an intermediate lever pivotally supported on the tag attacher body, a spring provided between the intermediate lever and the tag attacher body urging the intermediate lever in such a manner that the intermediate lever is normally projected in the forward direction from a grip portion of the tag attacher body, a spring support member provided slidably in the tag attacher body and fitted loosely into the intermediate lever, a cam driving member fitted loosely through the intermediate lever extending parallel to the spring support member, a hollow needle positioned in front of the spring support member and fixed to the tag attacher body, a bore provided at a rear end portion of the hollow needle adapted to guide the connecting bar of a tag pin assembly, a cam plate provided in a position adjacent to the guide bore and adapted to be moved by the free end of the cam driving member, a locking member pivotably provided on the cam plate and having locks positioned in the portion of the guide bore through which the connecting bar of the tag pin assembly is moved, and a spring provided between the locking member and tag attacher body, the locking member being adapted to come into engagement with the opposite surfaces of the connecting bar of the tag pin assembly, and apply force thereto for lowering the connecting bar in its guide bore.

Other characteristics of the tag attacher according to the present invention will be referred to in the following description of preferred embodiments.

BRIEF DESCRIPTION OF THE DRAWINGS

FIG. 6 is a perspective view of parts constituting a principal portion of the tag attacher according to the present invention;

FIGS. 7 and 8 are a front elevational view and a side elevational view, respectively, of a tag pin assembly.

DESCRIPTION OF THE PREFERRED EMBODIMENTS

The tag attacher according to the present invention, the basic construction of which is disclosed in U.S. Pat. No. 3,924,788, will be described in detail with reference to the accompanying drawings.

Figure 1:
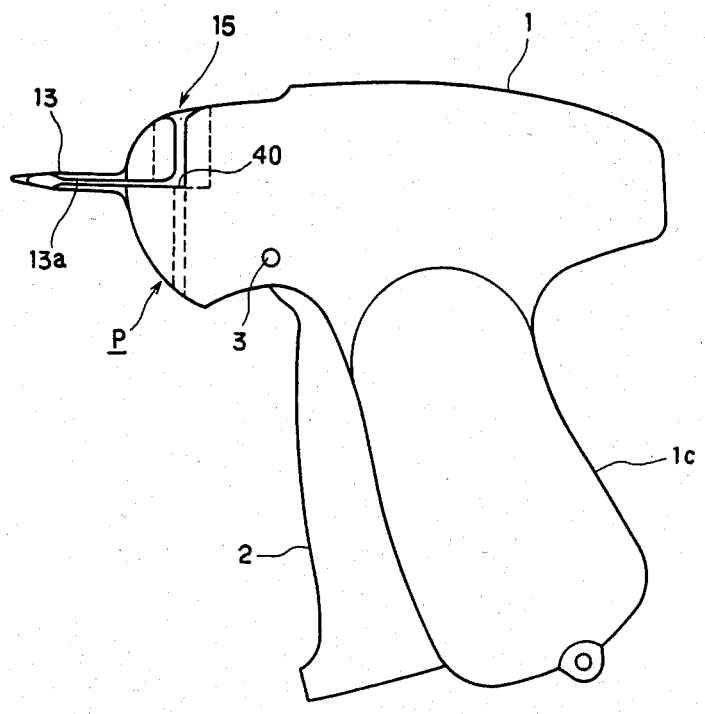
FIG. 1 is a side elevational view of a tag attacher.
Figure 2:
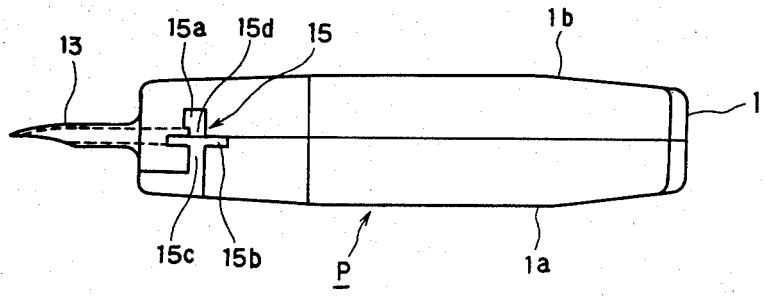
FIG. 2 is a plan view of the tag attacher.

Referring to FIGS. 1 and 2, a body 1 of a tag pin attacher P is molded out of a synthetic resin. It is formed in the shape of a pistol so as to be convenient to operate. The tag attacher body 1 consists of a pair of right and left members 1*a* and 1*b*, as shown in FIG. 2. A lever 2 is supported on the tag attacher body 1 via a shaft 3.

Figure 3:
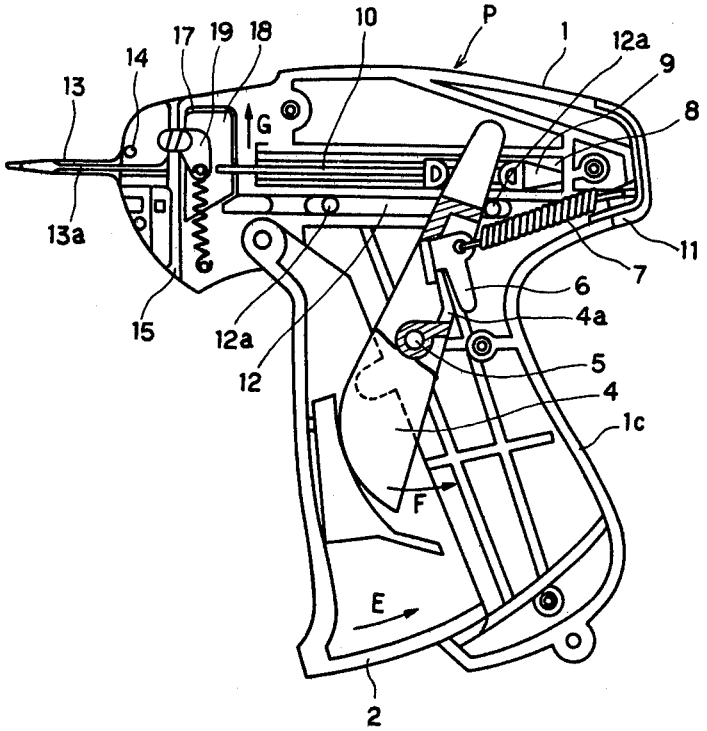
FIG. 3 shows the construction of an inner portion of the tag attacher.

As shown in FIG. 3, an intermediate lever 4 is pivotably connected via a shaft 5 to a grip portion 1*c* of the tag attacher body 1. The intermediate lever 4 is provided with a guide surface 4*a*, on which a spring support member 6 is slidably supported.

A spring 7 is provided between the spring support member 6 and a rear portion of the tag attacher body 1. The spring 7 normally urges the lever 2 to project outward from the grip portion 1*c* as shown in FIGS. 1 and 3.

A slider 9 is slidably provided in a horizontal bore 8 formed in the tag attacher body 1. A push rod 10 is fixed to the front end portion of the slider 9.

A bore 11 is provided under the bore 8, and a cam driving member 12 is slidably inserted in the bore 11.

The intermediate lever 4 is bifurcated at the upper portion thereof, and the slider 9 is supported at an intermediate narrowed portion thereof in the bifurcated portion of the intermediate lever 4. The cam driving member 12 is provided with two projections 12*a* on one surface thereof, and the intermediate lever 4 alternately comes into contact at the front and rear surfaces thereof with the projections 12*a* so as to move the cam driving member 12 forward and backward.

A hollow needle 13 having a side slit 13*a* is provided on the front of the tag attacher body 1 at a position in front of a surface on which the push rod 10 is moved. The hollow needle 13 can be attached to and detached from the tag attacher body 1 by setting or removing a stopper 14. A guide bore 15 for loading a tag pin assembly T therein is provided behind the hollow needle 13 and extends in a direction at right angles to the hollow needle 13.

As may be understood from FIGS. 1 and 2, the upper half of the guide bore 15, i.e. that portion of the guide bore 15 which is above the side slit in the hollow needle 13, is substantially cross-shaped.

The tag pin assembly T will now be described with reference to FIGS. 7 and 8. A tag pin t consists of a head portion h, a lateral rod b, and a filament f connecting these two portions together. A plurality of tag pins t are arranged at predetermined intervals p with the direction of thickness of the head portions h aligned. Each of the tag pins t is joined at a connecting portion c thereof to a connecting bar B.

Referring again to FIGS. 1 and 2, the tag pin assembly T passes through the guide bore 15 which is roughly cross-shaped. Reference numeral 15*a* denotes a bore for inserting the connecting bar B therein, 15*b* a bore for the lateral rods b, 15*c* a bore for the filaments f, and 15*d* a bore for the connecting portions c.

The bore 15*b* extends downward and terminates in a plane including the lower surface of the bore in the hollow needle 13. The bore 15*b* is adapted so that the lateral rod b of the tag pin t will be stopped at the rear end of the hollow needle 13 so it may be struck out therethrough.

In order to insert the tag pin assembly T into the guide bore 15, the connecting bar B is first put in bore 15*a*, and the lateral rods b are then put in bore 15*b*.

The filaments f, which extend from the lateral rods b and have the head portions h at the other ends thereof, project sideways from the tag attacher body 1 through the bore 15*c*. The connecting portions c, which join the tag pins t to the connecting bar, are consequently inserted in bore 15*d*.

The details of the feed means for the tag pin assembly T, which constitutes a principal portion of the present invention, will be described with reference to FIGS. 4 and 5.

A bore 17 is provided in a front portion of the interior of the tag attacher body 1, and communicated with the bore 11 used for guiding the cam driving member 12 therein. A cam plate 18 having an inclined guide surface 18*a* at the lower side thereof is held in the bore 17 in such a manner that the cam plate 18 can be moved up and down therein. The cam plate 18 is provided with a locking member 19 pivotally supported thereon. As shown in FIG. 6, the locking member 19 is provided on the rear surface thereof with a shaft 19*a* formed integrally therewith and inserted into a bore provided in the cam plate 18. The locking member 19 has at a front portion thereof locks 19*b* consisting of two claws, and these claw type locks are positioned on opposite surfaces of the connecting bar B.

The locking member 19 is substantially in the shape of the letter "L", and a spring 20 is provided. Spring 20 is fastened at one end to a projection 19*c* formed on a lower portion of the locking member 19, and at the other end to a projection 21 formed on the tag attacher body 1.

Accordingly, the locking member 19 is drawn downward by the resilient force of spring 20, and, at the same time, a force for rotating the locking member 19 in the direction of arrow M, i.e. in the rightward direction in the drawing, is applied thereto.

Figure 4:
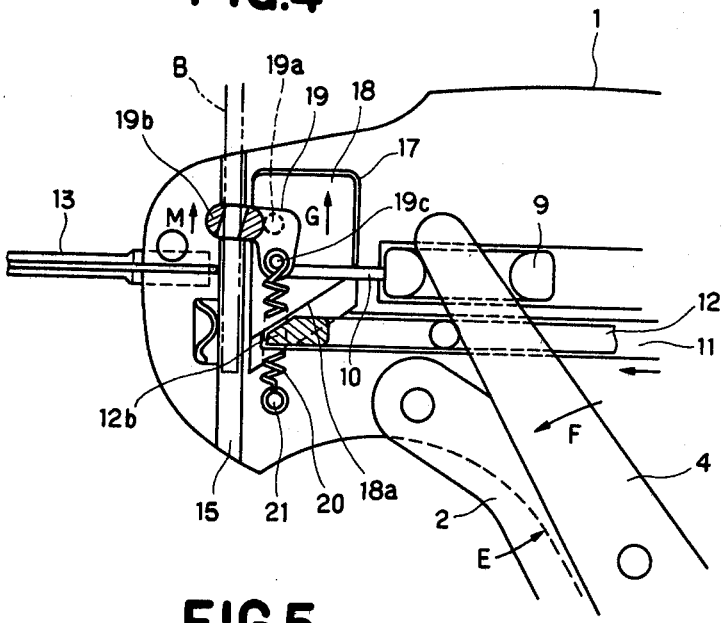
Fig. 4 shows the construction of a principal portion of the tag attacher with a locking member moved up in the guide recess.

The shaft 19*a* and projection 19*c* provided on the locking member 19 are not in alignment with each other as shown in FIG. 4, and moment of rotation due to the force of spring 20 is thus applied to the locking member 19.

The locks 19*b* provided on the free end portion of the locking member 19 are formed in an inclined state as shown in FIGS. 4 and 6. The end portions of the locks 19*b* are in contact with the opposite surfaces of the connecting bar B to apply thereto a twisting force in the rightward direction in which the locking member 19 is oscillated. Therefore, frictional force for supporting the connecting bar B occurs on the locks 19*b* of the locking member 19, so that the connecting bar B can be drawn downwardly in accordance with a downward movement of the cam plate 18.

A stopper 22 is provided at a position which is below the hollow needle 13 and on one side of the guide bore 15*a* for the connecting bar B. The stopper 22 is adapted to press a side surface of the connecting bar B, and thereby prevent the connecting bar B from being moved upwardly when the locking member 19 is moved upwardly along the connecting bar B.

Figure 9:
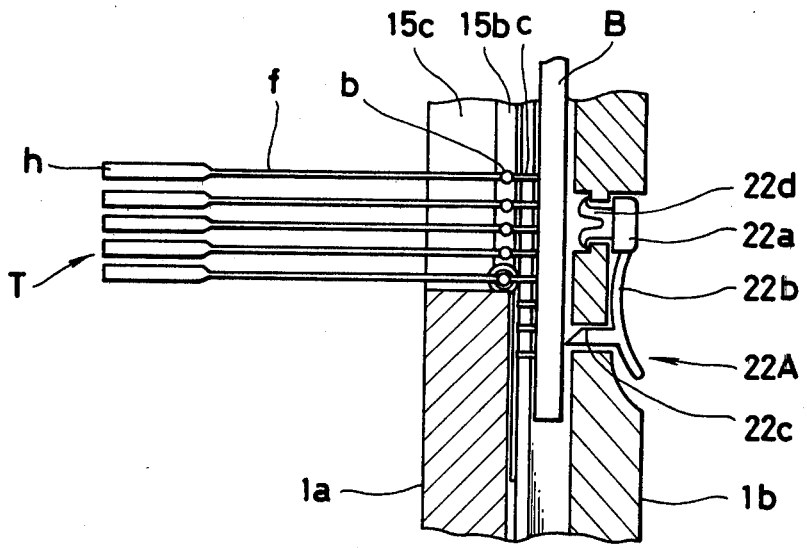
FIG. 9 is a sectional view, showing a modified example of the structure of the stopper in the tag attacher according to the invention.

Of the above stopper 22, a modified structure is shown in FIG. 9 as indicated at 22A, which is molded from a synthetic resin and received in a cavity formed in the member 1b of the tag attacher body 1. The stopper 22A in this example comprises an anchor part 22a having two stopper pawls 22d, a spring part 22b connected to and extending from the anchor part and a stopper claw 22c projected at a portion close to the other end of the spring part 22b. The function of the stopper 22A is such that it is contacted relatively strongly with a side surface of the connecting bar B of the tag pin assembly and exerts a brake action upon the tag pin assembly. The stopper pawls 22c, which have a tendency to expand or flare in a bore formed in the tag attacher member 1b, are securely held in position as being hooked at the inner face of shoulder formed on the wall of the bore.

When the cam plate 18 is moved downward, the spring 20 is contracted, so that the moment M in the rightward direction being applied to the locking member 19 is reduced. Accordingly, the gripping force applied to the connecting bar B is also reduced. The stopper 22 should be designed to generate a force large enough to prevent the connecting bar B from being drawn by the locks 19b of the locking member 19 when the cam plate 18 is moved up in the subsequent step.

The operation of the tag attacher according to the present invention will be described.

FIG. 4 shows lever 2 drawn into the grip portion 1c of the tag attacher body 1 by a gripping force applied thereto. When lever 2 is pivoted in the direction of arrow E in FIG. 3 to pivot the intermediate lever 4 in engagement therewith in the direction of arrow F, the slider 9 in engagement with an upper end portion of the intermediate lever 4 is moved forward. Consequently the end surface of the lateral rod b of a tag pin t in the tag pin assembly T is pressed by the push rod 10 fixed to the slider 9, and the lateral rod b is thus forced into the rear of the hollow needle 13.

When the intermediate lever 4 is moved forward as shown in FIG. 4, driving the slider 9 and cam driving member 12 forward, a cam-driving portion 12b at the front end of the cam driving member 12 comes into contact with an inclined surface 18a of the cam plate 18 and pushes the cam plate 18 up, i.e. in the direction of arrow G. When the cam plate 18 is moved up, the locks 19b on the locking member 19 supported thereon are moved up in the direction of arrow G sliding on the side surfaces of the connecting bar B of the tag pin assembly T. (FIG. 4 shows the final stage of the cam driving operation.)

Figure 5:
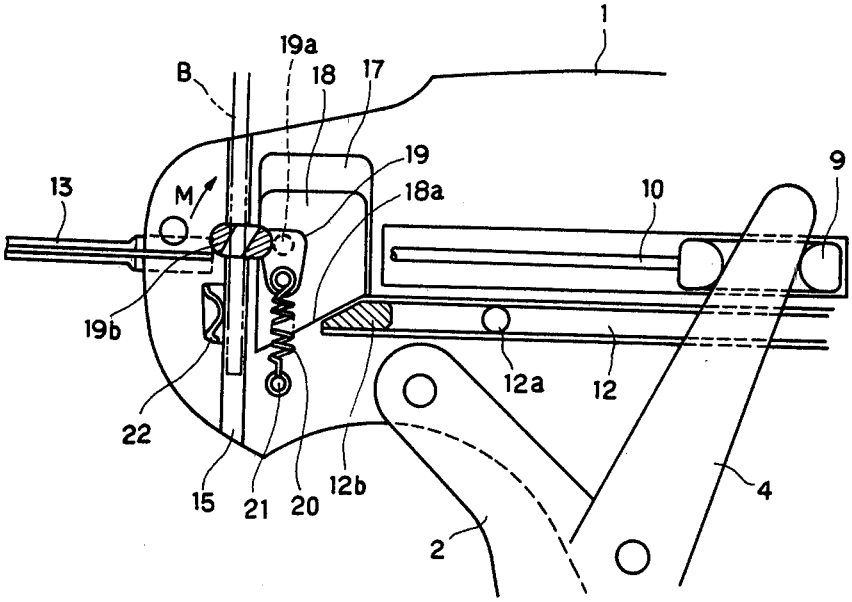
FIG. 5 shows the same portion of the tag attacher as shown in FIG. 4 with a tag pin assembly in the down position.

When lever 2 is then released from the gripping force applied thereto, the lever 2 and intermediate lever 4 are pivoted as shown in FIG. 5 in the directions opposite to the directions of arrows E and F shown in FIG. 4. Accordingly, the push rod 10 and cam driving member 12 are drawn back.

When the cam driving member 12 has been drawn back as mentioned above, the projection 12a provided on the end surface of the cam driving member 12 withdraws from the cam plate 18, releasing the cam plate 18 from the upward force applied to it, so the cam plate 18 and the connecting bar B engaged with the locking member 19 are drawn downward by the resilient force of spring 20 applied to the cam plate 18 as mentioned above. (FIG. 5 shows lever 2 in the released state with the cam plate 18 and connecting bar B lowered.)

Spring 20 brings the locks 19b of the locking member 19 into press contact with the opposite surfaces of the connecting bar B. Accordingly, the connecting bar B is drawn downward until the lateral rod b of the lowermost tag pin t is positioned at the inlet of the hollow needle 13, thus completing the preparations for driving the subsequent tag pin t.

According to the present invention described above, the cam driving member 12 is moved to the right and left as the lever 2 is drawn in and released. When the cam driving member 12 is moved forward, the cam plate 18 is moved upward by the driving portion 12b formed at the front end of the cam driving member 12, to move the locking member 19 pivotably supported on the cam plate 18 up at the same time. Consequently, the locks 19b hold the side surfaces of the connecting bar B which is integrally formed with the tag pin assembly T, in a pressing (twisting) manner.

Thereafter, the cam plate 18 and locking member 19 pivotably supported thereon are moved down together as the lever 2 is released, moving the connecting bar B down. Thus, a tag pin t can be fed to the inlet of the hollow needle 13.

According to the present invention, the locks 19b of the locking member 19 come into contact with opposite surfaces of the connecting member B of the tag pin assembly T in a special manner, i.e. in a press-twisting manner. Accordingly, the feed distance is correct irrespective of the pitch p of the tag pins t joined perpendicularly to the connecting bar B, so that the tag pins can be fed smoothly. When the distance that the cam plate 18 is moved up each time is greater than the pitch p referred to above, the excess distance is left as the expansion of the spring 20 connected to the locking member 19.

The tag attacher according to the present invention permits as mentioned above loading tag pin assemblies having tag pins of various pitches, and smoothly attaching the tag pins to articles. It also permits use of a tag pin assembly T having connecting portions c arranged very closely to one another.

Thereafter, the tag attacher according to the present invention, unlike a conventional tag attacher, is not provided with a gear with teeth fitting among the connecting portions c of a tag pin assembly T to feed the tag pins intermittently, and so permits even tag pins made by different manufacturers or have different sized parts in the guide bore 15 to be loaded and driven into articles smoothly.

What is claimed is:

1. A tag attacher for attaching tag pins which are connected together in spaced relation along a connecting bar as a tag pin assembly, comprising a tag attacher body; lever means pivotably supported on said tag attacher body for displacement between first and second positions; a hollow needle having a rear end supported on a said tag attacher body and a front end projecting from said tag attacher body, said attacher body being formed with a guide bore aligned with said rear end of said hollow needle and adapted to guide said connecting bar of said tag pin assembly; tag pin ejector means coupled to said lever means for displacing the tag pin in registration with said hollow needle, in response to the displacement of said lever means from its first to its second position, so as to eject said tag pin at least in part through said hollow needle while separating said tag pin from said connecting bar; a cam member mounted for displacement adjacent said guide bore; a cam driving member loosely coupled to said lever means for displacement thereby during at least a portion of the displacement of said lever means and positioned for engagement with said cam member for displacement of said cam member; a locking member pivotably mounted on said cam member and having at least a pair of projections positioned in said guide bore in registration with the path of the connecting bar of the tag pin assembly between which the connecting bar is held; and spring means coupled between said locking member and said tag attacher body so that said projections forcefully engage said connecting bar during the displacement of said cam member in one direction for displacing said connecting bar in said guide bore to position the next tag pin in registration with said hollow needle.

2. A tag attacher according to claim 1, wherein said cam member is displacable along said connecting bar against the bias of said spring means without displacing said connecting bar during at least a portion of the displacement of said lever means from its first to its second position and said tag pin ejector means is ejecting the tag pin in registration with said hollow needle.

3. A tag attacher according to claim 2, wherein said cam member is displaced with said locking member projections in forceful engagement with said connecting bar to displace said connecting bar during at least a portion of the displacement of said lever means from its second position to its first position.

4. A tag attacher according to claim 2, including further spring means coupled between said lever means and said tag attacher body for biasing said lever means at its first position.

5. A tag attacher according to claim 3, wherein said spring means is adapted to maintain said cam member in engagement with said cam driving member.

6. A tag attacher according to claim 3, wherein said cam member has a lower side formed with a guide surface adapted for engagement by a free end portion of said cam driving member.

7. A tag attacher according to claim 1, wherein said locking member has two projections.

8. A tag attacher according to claim 1, wherein tag attacher body is formed with a grip portion, said lever means being a portion projecting forwardedly of said grip portion, said cam member being adapted to be moved in the upward direction along the connecting bar together with said locking member when said lever means is displaced from its first to its second position, said lever means being joined to said tag attacher body in such a manner that said lever means can be drawn into the interior of said grip portion of said tag attacher body when displaced to said second position.

9. A tag attacher according to claim 1, wherein said locking member provided on said cam plate is in the shape of the letter "L", and said locking member being provided at one end portion thereof with said attachments adapted to press against the side surfaces of the connecting bar, and is connected at the other end portion thereof to said spring means to said cam member in the downward direction.

* * * * *